US006942114B2

(12) United States Patent
Nishida

(10) Patent No.: US 6,942,114 B2
(45) Date of Patent: Sep. 13, 2005

(54) CAP FOR CONTAINER

(75) Inventor: Ryuhei Nishida, Yokohama (JP)

(73) Assignee: Nifco Inc., Yokohama (JP)

( * ) Notice: Subject to any disclaimer, the term of this patent is extended or adjusted under 35 U.S.C. 154(b) by 99 days.

(21) Appl. No.: 10/601,890

(22) Filed: Jun. 24, 2003

(65) Prior Publication Data

US 2004/0060891 A1 Apr. 1, 2004

(30) Foreign Application Priority Data

Sep. 27, 2002 (JP) ..... 2002-282417

(51) Int. Cl.[7] ..... B65D 41/04
(52) U.S. Cl. ..... 215/252; 215/258; 215/901
(58) Field of Search ..... 215/252, 253, 215/256, 258, 341, 344, 343, 223, 330, 901

(56) References Cited

U.S. PATENT DOCUMENTS 4,679,696 A * 7/1987 Bonnenfant et al. ..... 215/252
4,775,064 A * 10/1988 Baxter ..... 215/230
4,805,791 A * 2/1989 Begley ..... 215/252
5,076,453 A * 12/1991 Odet ..... 215/252
5,163,571 A * 11/1992 Morini ..... 215/252
5,433,331 A * 7/1995 Morini ..... 215/271
5,465,858 A * 11/1995 Gargione ..... 215/252
5,582,308 A * 12/1996 Kishi et al. ..... 215/252
5,813,553 A * 9/1998 Herr et al. ..... 215/252
6,006,932 A * 12/1999 Morini ..... 215/249
6,382,444 B1 * 5/2002 Nyman ..... 215/252
6,685,061 B2 * 2/2004 Wolf et al. ..... 222/153.06
6,793,101 B2 * 9/2004 Shinozaki et al. ..... 222/153.02

FOREIGN PATENT DOCUMENTS

JP 2561260 9/1996

* cited by examiner

*Primary Examiner*—Jes F. Pascua
*Assistant Examiner*—Niki M. Eloshway
(74) *Attorney, Agent, or Firm*—Manabu Kanesaka

(57) ABSTRACT

A cap is used for a container as a bottle or jar. The cap includes a cylindrical cap main portion with a closed upper end and an open lower end, and a ring member. The cap main portion is screwed in an upper portion of the cylindrical container to close an opening of the container with the closed upper end. The ring member includes engaging pieces formed on an inner periphery of the ring for hooking from below on an extraction controlling projection formed on an outer periphery of a base portion of the container. A plurality of window holes is disposed on a lower side of the cap main portion along a periphery thereof so that the integrated ring member can be seen from the outside.

10 Claims, 8 Drawing Sheets

CAP FOR CONTAINER

BACKGROUND OF THE INVENTION AND RELATED ART STATEMENT

The invention relates to a cap for a container. The cap is screwed in an upper portion of the container to close an opening of the container. When the cap is removed from the container for the first time, a part of the cap is separated and remains on the container. Therefore, the cap has a function of indicating the container has already been opened.

A cap for a container has been disclosed in Japanese Patent No. 2561260. The cap is screwed into an upper portion of the container to close an opening of the container. When the screwed cap is removed from the container, a part of the cap is separated so that it is recognized that the cap has already been opened.

The cap disclosed in Japanese Patent No. 2561260 is formed of a cap main portion and a ring member. The ring member includes an engaging projection to be engaged with a step portion formed on a lower end of an outer peripheral surface of the cap main portion, and an engaging piece to be engaged with a lower surface of a projection formed on a bottle opening. The engaging projection of the ring member is formed to surround the periphery thereof, and also, engaged with the step portion to cover the lower end of the outer peripheral surface of the cap main portion from the outside. In the engaged state, the engaging projection of the ring member is bent inwardly.

When the cap is removed from the bottle orifice cylinder for the first time, only the cap main portion is moved upward and the engagement between the step portion and the engaging projection is released. The engaging projection is deformed in a direction for releasing the engaging projection from the bent state in the course of releasing the engagement. When the engagement is completely released, the engagement projection is bent inwardly again. As a result, the lower end of the outer peripheral surface of the cap main portion is not covered again by the engaging projection of the ring member from the outside. Thus, it is possible to recognize that the cap is removed from the bottle orifice cylinder at least once.

In the cap disclosed in Japanese Patent No. 2561260, when the cap is not removed from the container, i.e. in an unopened state, the lower end of the outer periphery of the cap main portion is covered by the engaging projection of the ring member from the outside. Therefore, it is easily recognized that the cap is in the unopened state. However, the cap in the unopened state of the container does not provide a good appearance, thereby making it difficult to obtain a high quality design of the container using such a cap.

In the cap disclosed in Japanese Patent No. 2561260, the engaging projection of the ring member is structured to surround the periphery. Accordingly, after the cap main portion is separated from the ring member, it is relatively easy to reproduce the state that the engaging projection engages the step portion, i.e. the unopened state, by inserting a forward end of a driver into the ring member in the direction for releasing the bent of the engaging projection to insert the lower end portion of the outer peripheral surface of the cap main portion into the elastically deformed engaging projection while elastically deforming the ring member.

In view of the above defects, the present invention has been made, and an object of the invention is to provide a cap for a container such as a bottle or jar, wherein the cap in the unopened state can be clearly recognized to be in the unopened state and provided with a good appearance.

Further objects and advantages of the invention will be apparent from the following description of the invention.

SUMMARY OF THE INVENTION

In order to attain the above objects, according to the first aspect of the invention, a cap is used for a container formed in a bottle or jar shape. The cap includes a cylindrical cap main portion with a closed upper end and an opened lower end, and a ring member. The cap main portion is screwed in an upper portion of a cylindrical container to close an opening of the upper portion of the container with the closed upper end thereof. The ring member includes engaging pieces formed on an inner periphery of the ring to be hooked from below on an extraction controlling projection formed on an outer periphery of a base portion of the upper portion of the container.

One of the cap main portion and the ring member is molded with an injection molding before molding the other, so that the outer surface of the ring member is closely attached to the inner surface of the cylindrical lower end side of the cap main portion to thereby be detachably integrated. A plurality of window holes is disposed on the cylindrical lower side of the cap main portion along a peripheral direction thereof so that the integrated ring member can be seen from the outside.

In the first aspect of the invention, the cap main portion is removed from the upper portion of the container from a state that the cap main portion is screwed in the upper portion of the container and the engaging piece of the ring member is hooked on the extraction controlling projection from below. That is, the cap main portion is twisted in the direction to release the screwed condition. As a result, the cap main portion is gradually raised step by step toward the upper side of the upper portion of the container. In this state, the engaging pieces of the ring member do not move upward from the position where the engaging pieces are hooked on the extraction controlling projection. Thus, a contact surface between the cap member and the ring member is detached, and the ring member is finally separated from the cap member, so that the ring member remains on the container main portion side. Thus, the user of the container can recognize that the cap is removed from the upper portion of the container at least once.

In the first aspect of the invention, one of the cap main portion and the ring member is molded with the injection molding before molding the other, so that the outer surface of the ring member is closely attached to the inner surface of the cap main portion on the cylindrical lower end side to thereby detachably integrate the ring member with the cap main portion. The cap having a partial separation function can be easily and adequately produced. At the same time, the cap member can not be removed from the upper portion of the container unless such a large twisting force as to separate both members is applied to the cap member. Thus, the cap member is not easily removed from the upper portion of the container, thereby eliminating a chance that the container is opened inadvertently.

In the first aspect of the invention, since the cap main portion is integrated with the ring member, the cap main portion can be separated from the upper portion of the container, i.e. the container can be opened, for the first time without applying an excessively large twisting force to the cap main portion. Also, the ring member is disposed inside the cap main portion before it is separated from the cap main portion, so that the upper portion of the container has a good appearance.

In the first aspect of the invention, a plurality of the window holes is provided on the cylindrical lower end of the cap main portion along the peripheral direction thereof for enabling a user to see the ring member from the outside. Thus, it is easy to recognize through the window holes that the cap main portion has been removed from the container upper portion at least once.

More specifically, the ring member is detachably integrated with the cap main portion. Accordingly, unless the cap main portion is removed from the container upper portion, the ring member can be seen from the outside through the window holes. In other words, it is possible to see the inside of the cap main portion. Thus, it can recognize that the cap main portion has never been removed from the upper portion of the container. Since the window holes are disposed along the peripheral direction of the cap main portion, the ring member can be confirmed from any direction of the upper portion of the container.

When the cap main portion is removed at least once from the upper portion of the container, the ring member is separated from the cap main portion. Accordingly, it is possible to recognize immediately that the ring member is not present inside the cap main portion through the window holes. Thus, it is possible to confirm that the cap main portion is removed from the upper portion of the container at least once.

According to the second aspect of the invention, in the cap for the container in the jar or bottle shape according to the first aspect of the invention, fin-like members are formed on an outer periphery of the ring member of the cap to project toward the cylindrical upper end side of the cap main portion. Further, the fin-like members are inserted into the thick portion of the cap main portion so that the cap main portion and the ring member are detachably integrated. A projecting end side of the fin-like member is inclined toward a direction to cross the cylinder axis of the cap main portion.

In the second aspect of the invention, when the cap main portion is removed from the container upper portion for the first time, the cap main portion is separated from the ring member as the fin-like member is extracted from the thick portion of the cap main portion.

In the second aspect of the invention, the fin-like member is inclined as described above. In order to create an integrated state of the cap main portion and the ring member from the state that the cap main portion is separated from the ring member, it is necessary to insert the fin-like member into the thick portion of the cap main portion. Thus, it is difficult to return the fin-like member to the original position. As a result, after the cap main portion is removed from the container upper portion at least once, it is difficult to integrate the cap main portion with the ring member as in the original state. Thus, it is difficult to intentionally conceal a fact that the cap main portion is removed from the container upper portion at least once, i.e. the container is opened at least once.

In the second aspect of the invention, it is possible to prevent the cap main portion from being integrated with the ring member inadvertently to an original state when the cap main portion is screwed in the container upper portion from the separated state of the cap main portion and the ring member.

According to the third aspect of the invention, in the cap for the container in the jar or bottle shape according to the first and second aspects, the engaging pieces of the ring member are structured to be pressed against the extraction controlling projection when the cap main portion is screwed in the upper portion of the container to direct toward the cylindrical upper end of the cap main portion and to make the extraction controlling projection escape to the upper side of the forward ends while elastically deforming the forward ends of the engaging pieces.

Further, the forward ends of the engaging pieces are structured to hook on the extraction controlling projection from below due to the elasticity when the cap main portion is completely screwed in the upper portion of the container.

In the third aspect of the invention, when the cap having the cap main portion and the ring member is screwed in the upper portion of the container, the cap main portion is fixed to the upper portion of the container to thereby seal the opening of the upper portion of the container. At the same time, the engaging pieces of the ring member are adequately hooked on the extraction controlling projection from below.

According to the fourth aspect of the invention, in the cap for the container in the jar or bottle shape according to one of the first through third aspects, the ring member is formed of two or more ring components connected through thin portions.

In the fourth aspect of the invention, the engaging pieces are hooked on the extraction controlling projection, so that the ring member on the upper portion of the container are relatively easily removed from the upper portion of the container mainly when the container is thrown away.

More specifically, after the cap main portion is removed from the container upper portion, when the ring member is pulled so that the container upper portion is extracted from the ring member, the ring member can be deformed so that the ring lower end side of the ring constituting members is outwardly expanded around the thin portion. When the ring member is deformed as described above, an angle between the cylinder axis of the cap main portion and a projecting direction of the engaging piece, which is formed on the inner periphery of the ring member and projected toward the cylinder upper end side of the cap main portion so that the forward end of the engaging piece can be hooked on the extraction controlling projection from the lower side, becomes slightly larger.

Accordingly, the engaging piece projecting upward pushes the extraction controlling projection and is easily bent downward. From this state, the ring member is pulled upward and extracted toward the lower side of the forward end of the engaging piece to move over the extraction controlling projection smoothly. Thus, the ring member on the container upper portion side is relatively easily removed from the container upper portion when the container is thrown away.

DETAILED DESCRIPTION OF A PREFERRED EMBODIMENT

Hereunder, with reference to FIGS. 1 through 11, an embodiment of the present invention will be described in detail.

Figure 1:
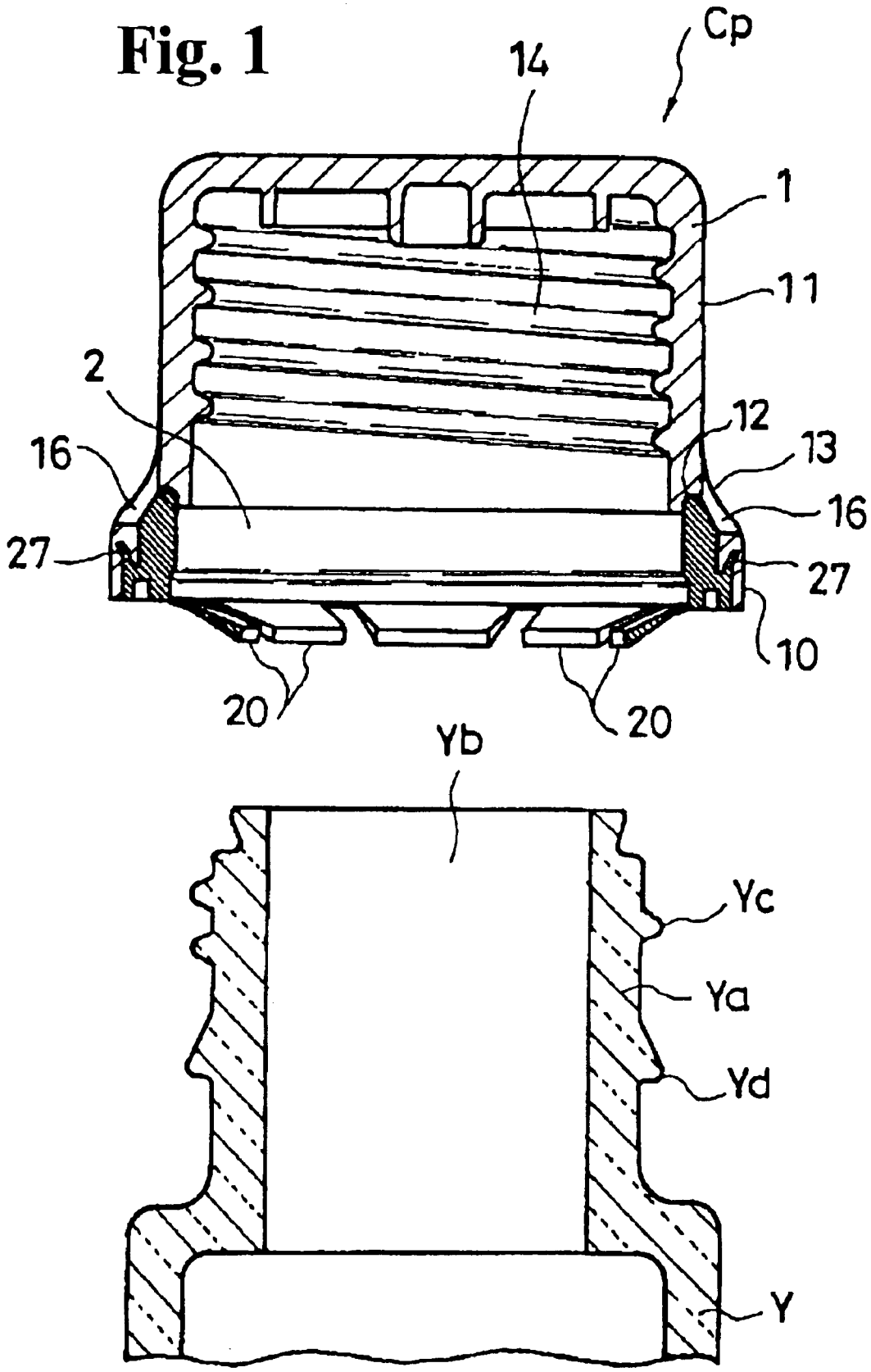
FIG. 1 is a sectional view showing a cap and an upper portion of a container.
Figure 2:
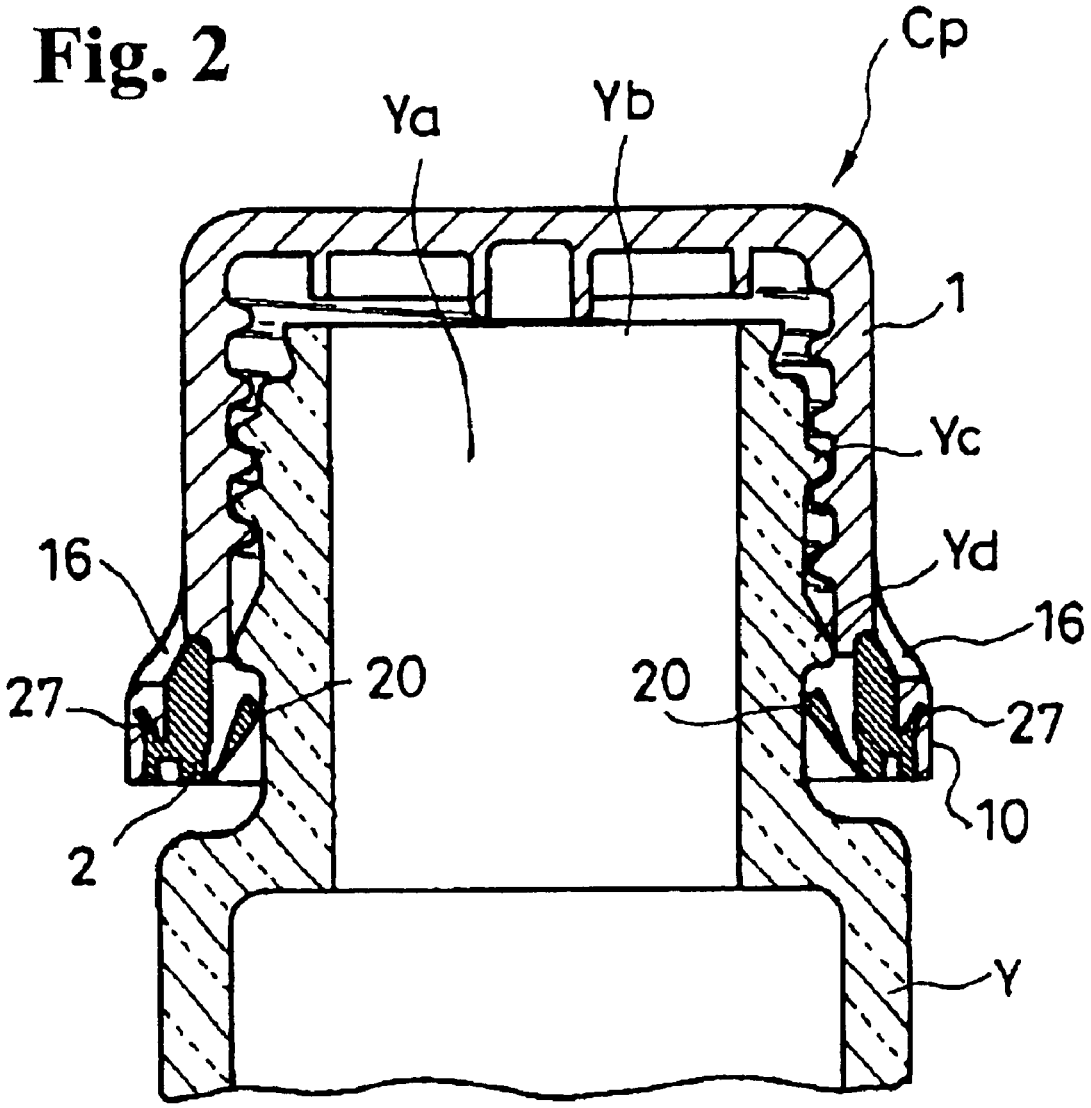
FIG. 2 is a sectional view showing the cap and the upper portion of the container in a closed state.
Figure 3:
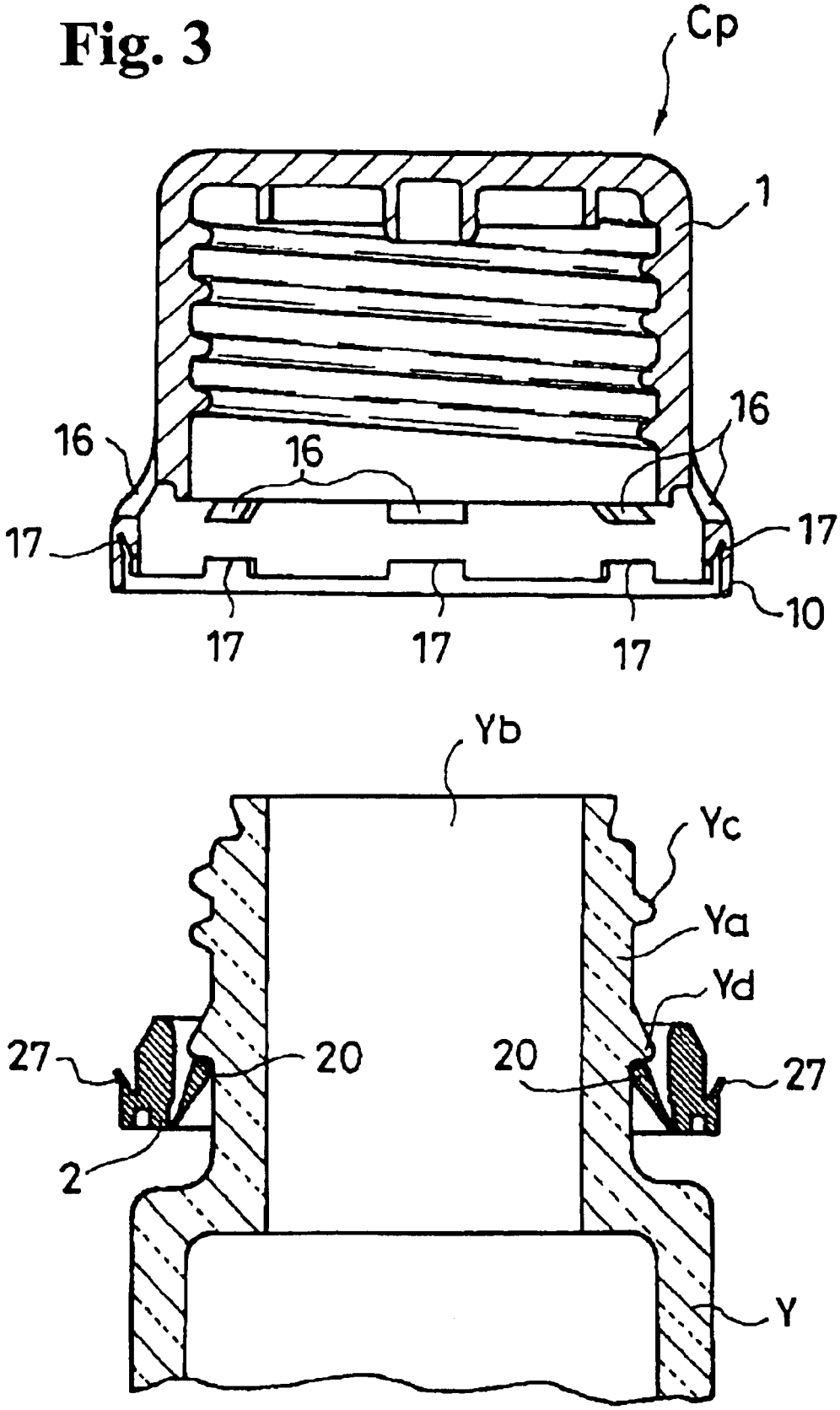
FIG. 3 is a sectional view showing the cap and the upper portion of the container in an open state.
Figure 4:
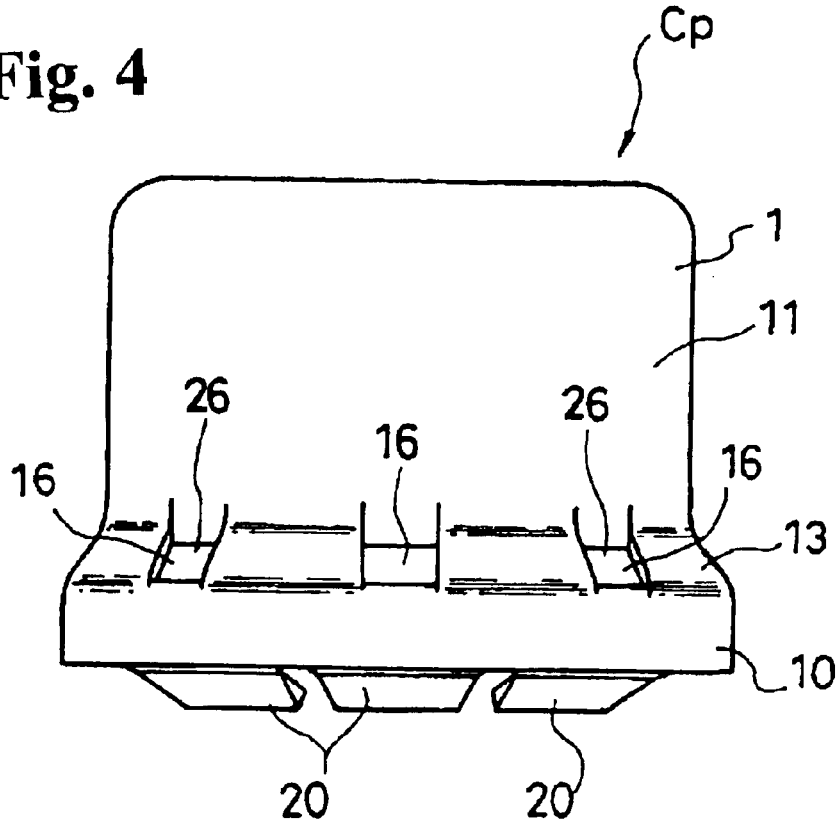
FIG. 4 is a front view of the cap.
Figure 5:
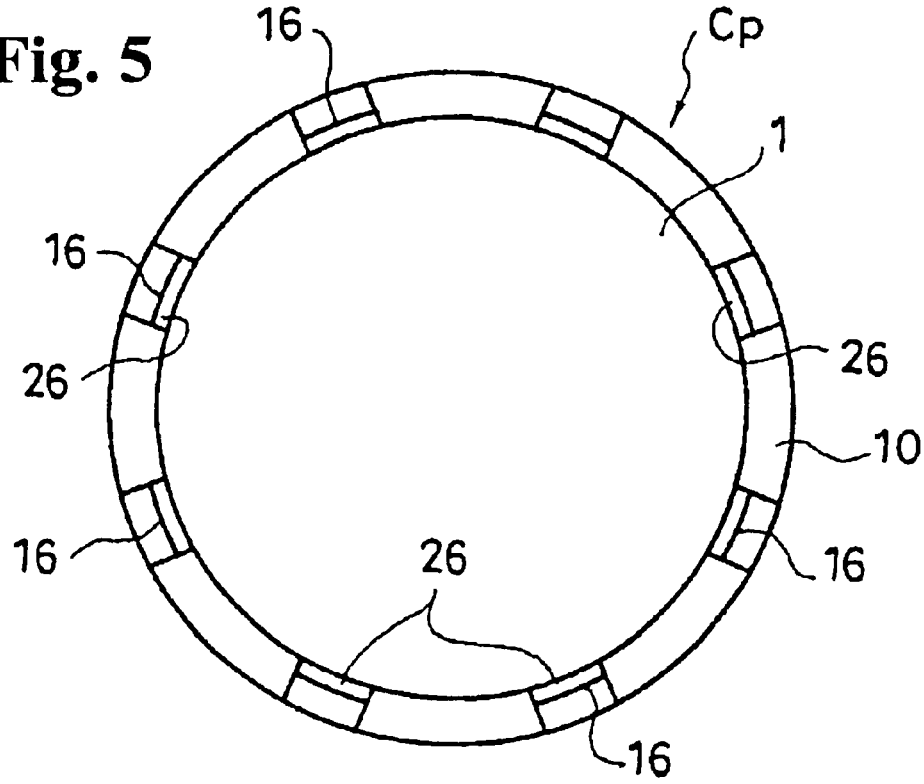
FIG. 5 is a plan view of the cap.
Figure 6:
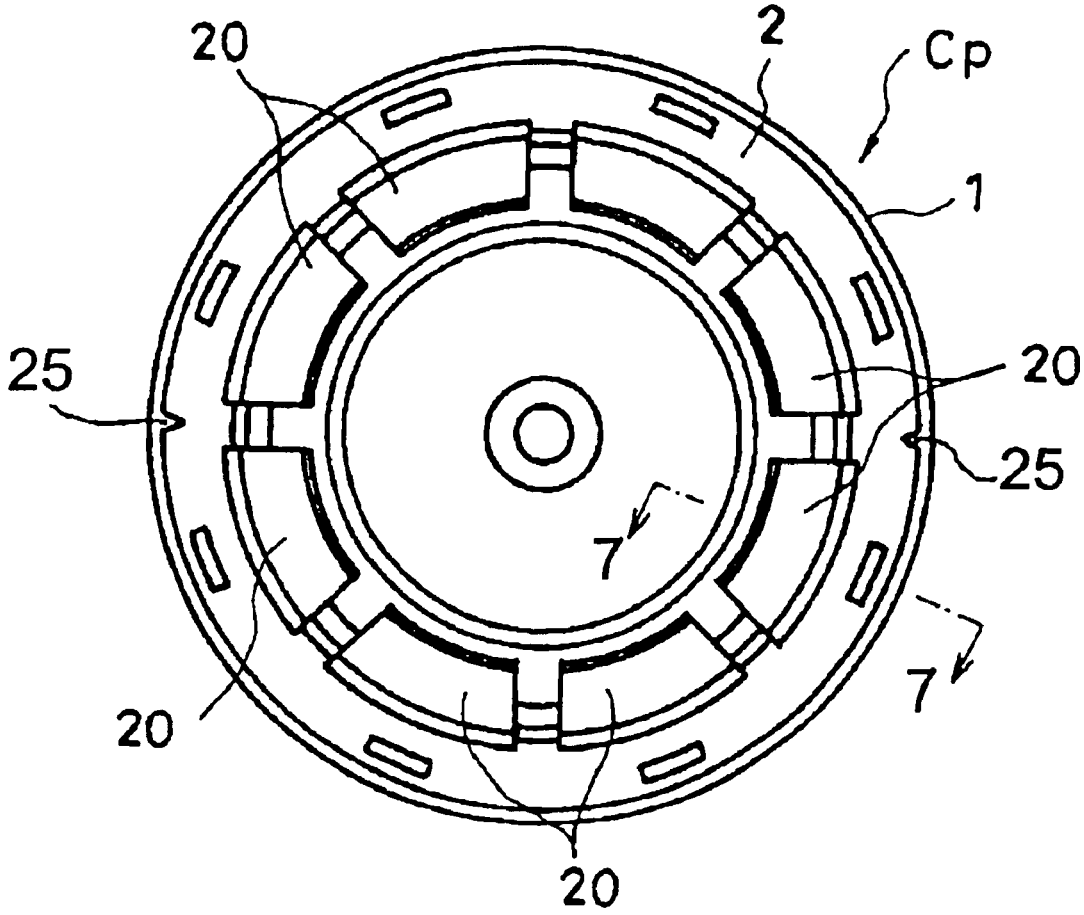
FIG. 6 is a bottom view of the cap.
Figure 7:
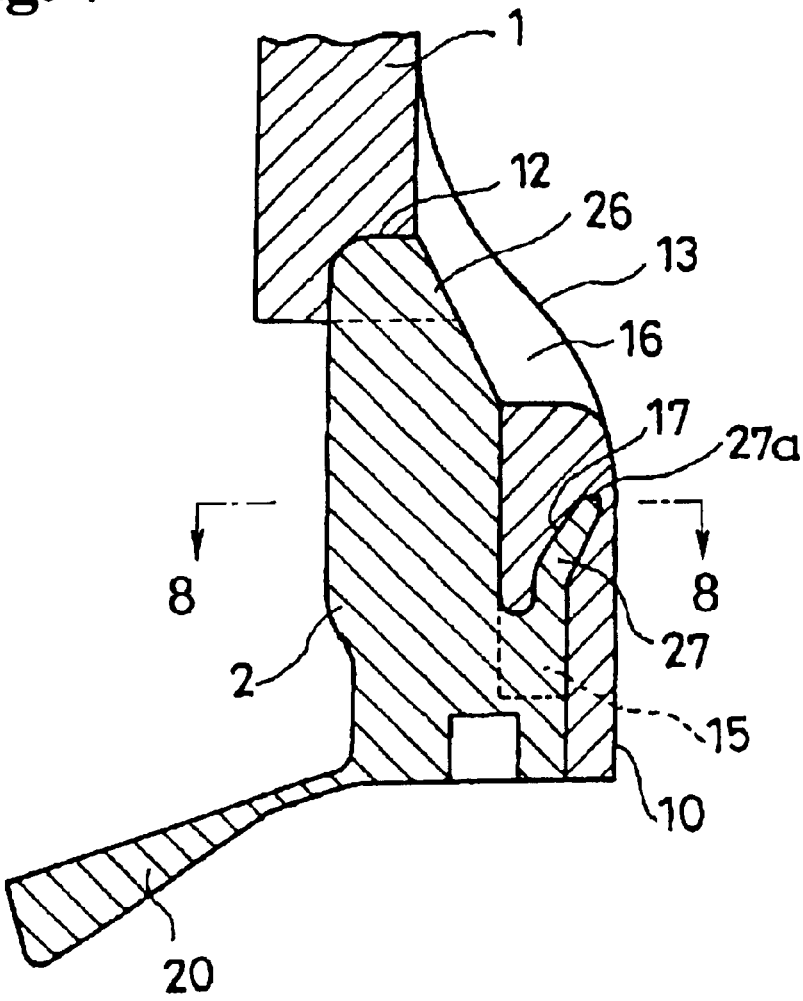
FIG. 7 is a sectional view taken along line 7—7 in FIG. 6.
Figure 8:
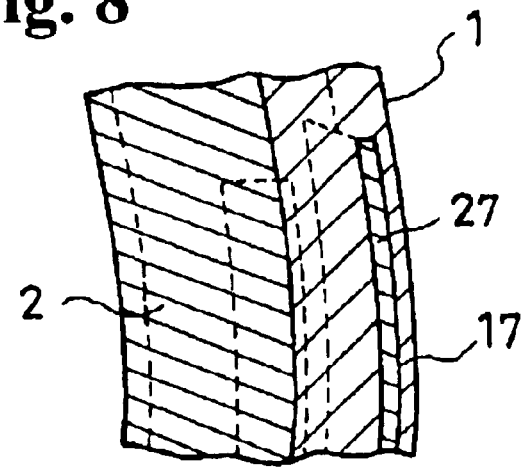
FIG. 8 is a sectional view taken along line 8—8 in FIG. 7.

FIG. 1 shows a state right before a cap Cp according to the embodiment is attached to an upper portion Ya of a container Y; FIG. 2 shows a state that the cap Cp is attached to the container Y to seal the same; and FIG. 3 shows a state that the cap Cp is removed from the container Y to release the sealing of the container Y.

Figure 9:
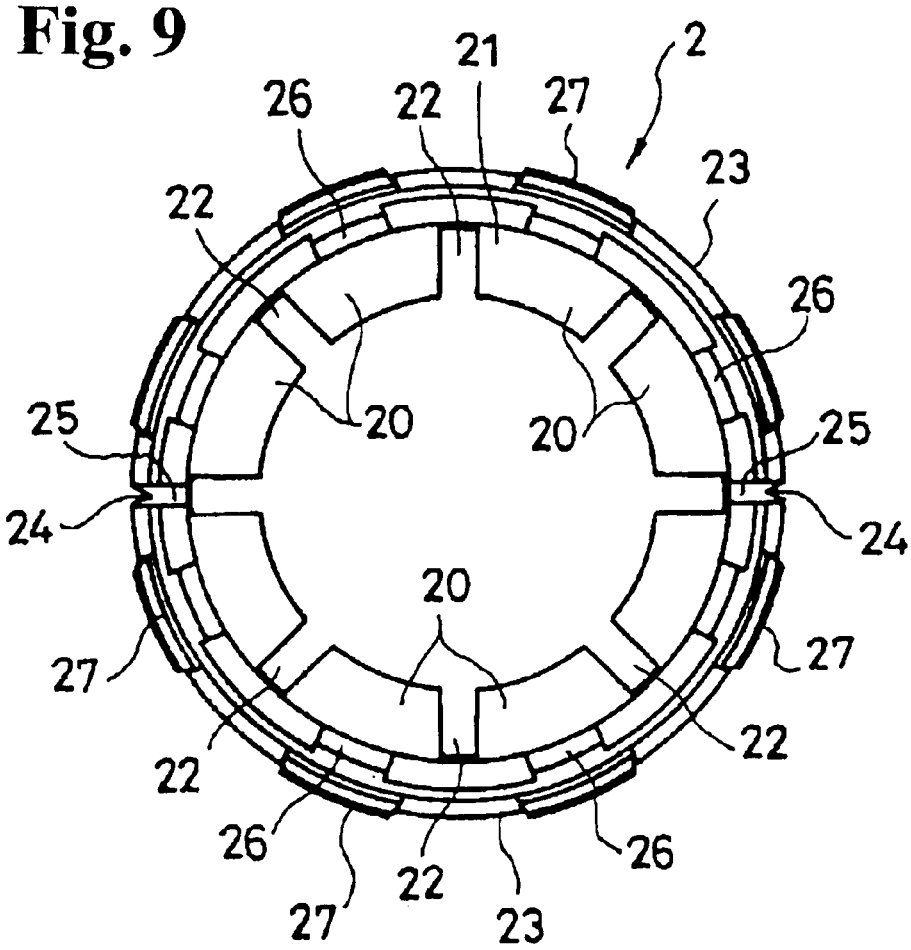
FIG. 9 is a plan view of the ring member.
Figure 10:
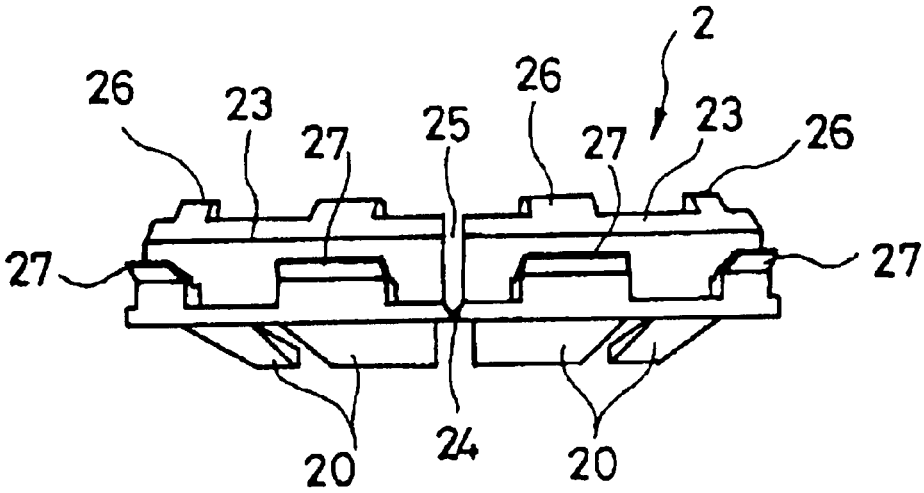
FIG. 10 is a side view of the ring member.
Figure 11:
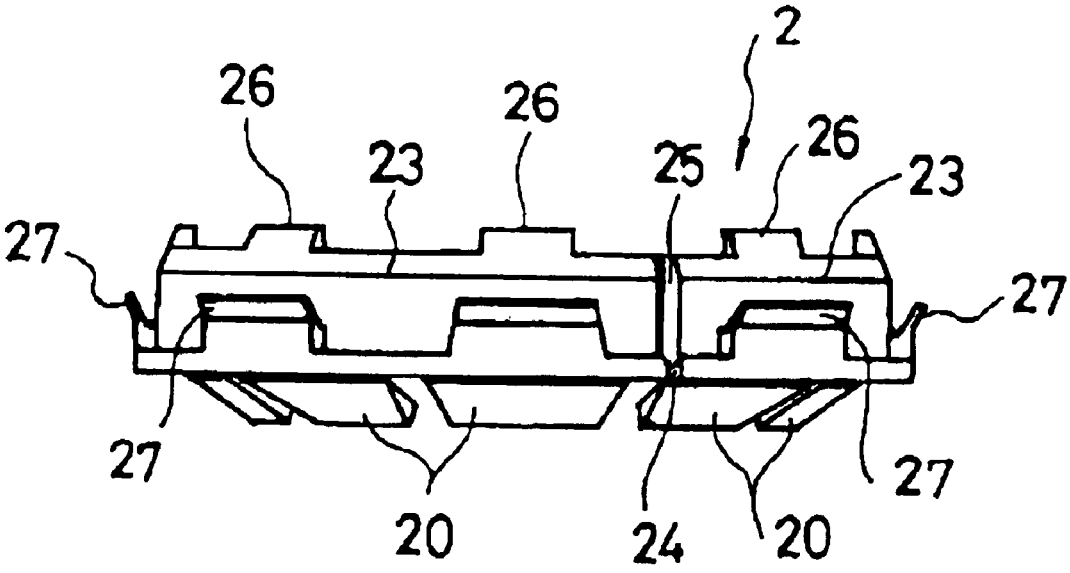
FIG. 11 is a side view seen from a direction different from that of FIG. 10.

FIGS. 4 through 8 show the cap Cp; and FIGS. 9 through 11 show only a ring member 2 constituting a cap main portion 1 and the cap Cp and detachably integrated with the main portion of the cap Cp.

According to the embodiment, the cap Cp is screwed into an upper portion Ya of the container Y to seal an opening Yb of the upper portion Ya. A part of the cap Cp is separated when the cap Cp is removed from the container for the first time. Accordingly, the cap Cp has a function of indicating that the container Y has already been opened.

Specifically, the cap Cp is structured such that the cap Cp is screwed in the upper portion Ya of the container Y to seal the opening Yb of the container upper portion Ya. Then, when the cap Cp is removed from the container Y for the first time, a part of the cap Cp is separated from the cap Cp and remains on a side of the upper portion Ya of the container, and the opening Yb of the upper portion Ya is opened.

After the cap Cp is removed for the first time, the cap Cp can be screwed into the upper portion Ya and removed therefrom at any number of times. However, as described above, the separated part of the cap Cp remains on the side of the upper portion Ya of the container.

As the container Y as described above, it may be a container formed in a jar or bottle shape for retaining various foods, flavoring matters, beverages, medical supplies and the like. The opening Yb of the upper portion Ya of the container is an opening of the jar or bottle. The container Y may be formed of various materials, such as glass, ceramic ware, metal and plastic.

The cap Cp is designed to be moldable with an injection molding. The cap Cp is formed of the cap main portion 1 and the ring member 2. When the cap Cp is removed from the upper portion Ya of the container for the first time, the ring member 2 is separated from the cap main portion 1 and remains on the side of the upper portion Ya of the container.

The cap Cp is structured to screw in the upper portion Ya of the container. More specifically, the cap main portion 1 is structured to receive the upper portion Ya of the container therein, and the ring member 2 also houses the upper portion Ya of the container therein.

The opening Yb is formed at an upper end of the cylindrical upper portion Ya of the container. A lower portion of the cylindrical upper portion Ya of the container is integrally connected to a main portion of the container Y to form the container Y having the opening Yb at the upper end as a whole.

The cap main portion 1 is formed in a cylindrical shape having a closed upper end and an open lower end. In the embodiment shown in the drawings, the cap main portion 1 has a substantially cylindrical shape. A lower end of the cylinder of the cap main portion 1 has a diameter slightly larger than that of the other portion. Inner and outer surfaces of the cap main portion 1 are positioned at a side farther outer than those of the other portion to thereby form a skirt shape. (Hereinafter, the lower end of the cylinder with a larger diameter of the cap main portion 1 is referred to as "skirt-like portion 10", and the other portion except for the skirt-like portion 10 is referred to as "the main portion 11 of the cap main portion 1")

An inner circumferential step surface 12 facing a cylindrical lower end side of the cap main portion 1 is formed in an inner portion of the cap main portion 1 between the skirt-like portion 10 and the main portion 11. An outer circumferential step surface 13 facing a cylindrical upper end side of the cap main portion 1 is formed in an outer portion of the cap main portion 1. In the embodiment shown in the drawings, the outer circumferential step surface 13 formed in the outer portion of the cap main portion 1 has an inclined surface gradually widening outwardly from the cylindrical upper end side to the cylindrical lower end side of the cap main portion 1.

In the embodiment shown in the drawings, an end surface of the ring member 2 facing the cylindrical upper end of the cap main portion 1 is closely attached to the inner circumferential step surface 12. An outer surface, i.e. an outer peripheral surface, of the ring member 2 is closely attached to an inner surface, i.e. an inner peripheral surface, of the skirt-like portion 10, to thereby detachably integrate the cap main portion 1 with the ring member 2 by the molding, described later.

A female screw portion 14 spiraling around an axis of the cap main portion 1 is formed on the inner peripheral surface of the main portion 11 of the cap main portion 1. A male screw portion Yc spiraling around the axis of the upper portion Ya of the container is formed on the outer peripheral surface of the upper portion Ya of the container. The female screw portion 14 engages the male screw portion Yc so that the cap main portion 1 is screwed in the upper portion Ya of the container.

In the embodiment shown in the drawings, the ring member 2 has a short cylindrical shape. Specifically, the maximum length of the ring member 2 in the cylindrical axis direction is substantially the same as a dimension between the inner circumferential step surface 12 of the cap main portion 1 and the lower edge of the cylindrical cap main portion 1.

The ring member 2 includes engaging pieces 20 formed on the inner periphery thereof. An extraction controlling projection Yd is formed on an outer periphery of the base portion of the upper portion Ya of the container. The engaging pieces 20 can hook on the extraction controlling projection Yd from below.

In the embodiment shown in the drawings, an outer flange portion is formed along a peripheral direction of the upper portion Ya of the container below the male screw portion Yc of the upper portion Ya of the container, and constitutes the extraction controlling projection Yd.

A plurality of the engaging pieces 20 is formed along the inner periphery of the ring member 2. Specifically, the engaging pieces 20 are formed of inner flange members 21 extending inward from the lower end of the ring member 2 and notches 22 between the flange members 21 in the peripheral direction of the ring member 2 with substantially the same space. The notch 22 extends from a forward end to a base portion of the inner flange member 21. In other words, a part between the adjacent notches 22 constitutes one of the engaging pieces 20.

As shown in FIG. 1, the engaging pieces 20 project obliquely from the lower end of the ring member 2 in a state before the cap Cp is screwed in the upper portion Ya of the container.

In the embodiment shown in the drawings, it is arranged that an imaginary circle passing through the forward ends of the engaging pieces 20 has a diameter smaller than the maximum diameter of the male screw portion Yc of the upper portion Ya of the container, and smaller than the diameter of a portion provided with the extraction controlling projection Yd.

In the embodiment shown in the drawings, the engaging pieces 20 of the ring member 2 are pressed against the outer surface of the upper portion Ya of the container so that the forward ends of the engaging pieces 20 are elastically deformed toward the cylindrical upper end of the cap main portion 1 when the cap main portion 1 is screwed in the upper portion Ya of the container. The cap Cp is being screwed in the upper portion Ya of the container for the first time while the engaging pieces 20 deform elastically.

When the cap main portion 1 is further screwed in the upper portion Ya of the container, the engaging pieces 20 of the ring member 2 are pressed also against the extraction controlling projection Yd. Accordingly, the forward end of the engaging piece 20 elastically deforms toward the cylindrical upper end side of the cap main portion 1 so that the extraction controlling projection Yd is escaped to the upper side of the forward end. When the cap main portion 1 is completely screwed into the upper portion Ya of the container, the forward ends of the engaging pieces 20 hook on the extraction controlling projection Yd from below due to elasticity (Refer to FIG. 2).

As described above, in the embodiment shown in the drawings, the cap Cp is formed of the cap main portion 1 and the ring member 2 detachably integrated with the cap main portion 1. When the cap Cp is screwed in the upper portion Ya of the container for the first time, the cap main portion 1 is attached to the upper portion Ya of the container to thereby seal the opening Yb of the upper portion Ya of the container. At the same time, the engaging pieces 20 of the ring member 2 are adequately hooked on the extraction controlling projection Yd from below.

In the embodiment, one of the cap main portion 1 and the ring member 2 is molded with the injection molding before molding the other. Accordingly, the ring member 2 is detachably integrated with the cap main portion 1 so that the outer surface of the ring member 2 is closely attached to the inner surface of the cylindrical lower end of the cap main portion 1.

More specifically, the ring member 2 is detachably integrated with the cap main portion 1 through a two-material molding, an injection molding of the ring member 2 with inserting the cap main portion 1, or an injection molding of the cap main portion 1 with inserting the ring member 2.

In the cap Cp according to the invention, when the cap main portion 1 is screwed in the upper portion Ya of the container, the forward ends of the engaging pieces 20 of the ring member 2 are hooked on the extraction controlling projection Yd from below. Then, when the cap main portion 1 is removed from the upper portion Ya of the container, i.e. the cap main portion 1 is twisted in the direction to release the screwed condition, the cap main portion 1 is gradually raised step by step toward the upper side of the upper portion Ya of the container.

At this moment, the engaging pieces 20 of the ring member 2 do not move upward from the position where the engaging pieces 20 are hooked on the extraction controlling projection Yd. Accordingly, the ring member 2 is broken apart from the cap Cp member and is finally separated from the cap Cp member, so that the ring member 2 remains on the container Y side (Refer to FIG. 3). Thus, it is possible to recognize that the cap Cp has been removed from the upper portion Ya of the container at lease once.

In this embodiment, one of the cap main portion 1 and the ring member 2 is molded with the injection molding before molding the other. As a result, the outer surface of the ring member 2 is closely attached to the inner surface of the cylindrical lower end side of the cap main portion 1 to detachably integrate. Therefore, it is easy to adequately produce the cap Cp having a partial separation function. Further, the cap Cp member is not removed from the upper portion Ya of the container unless such a large twisting force as to separate both members is applied to the cap Cp member, thereby eliminating a chance that the cap Cp member is removed inadvertently from the upper portion Ya of the container.

In the embodiment, the ring member 2 is integrated with the cap main portion 1 as described above. Therefore, after it is separated from the ring member 2, it is possible to remove the cap main portion 1 from the upper portion Ya of the container, i.e. opening the container Y, without applying an excessive twisting force to the cap main portion 1. Also, the ring member 2 is disposed inside the cap main portion 1 before separated from the cap main portion 1, thereby providing a good appearance of the upper portion Ya of the container.

In the embodiment, the ring member 2 is formed of more than two ring members 23 connected together through thin portions. As shown in the drawings, the ring member 2 is formed of two semi-circular arc ring constituting members 23 in plan view.

Specifically, splitting slots 25 divides the ring member 2 into two ring constituting members 23. The splitting slots 25 are formed on both sides of the ring member 2 in a radial direction, respectively. Each of the splitting slots 25 cuts an opening outward at the upper end of the ring, and extends from the ring upper end to the ring lower end. The thin portion 24 is formed between the ring lower end surface and the groove bottom of the splitting slots 25.

With this configuration, the engaging pieces 20 are hooked on the extraction controlling projection Yd. The ring member 2 always remains on the upper portion Ya of the container, and it is relatively easy to remove the ring member 2 from the upper portion Ya of the container mainly when the container Y is thrown away.

More specifically, after the cap main portion 1 is removed from the container upper portion Ya, when the ring member 2 is pulled so that the ring member 2 is extracted from the container upper portion Ya, the ring member 2 can deform so that the ring lower end side of the ring constituting member 23 is outwardly expanded around the thin portion 24. When the ring member 2 deforms as described above, an angle between the cylinder axis of the cap main portion 1 and a projecting direction of the engaging piece 20, which is formed on the inner periphery of the ring member 2 and projects toward the cylinder upper end side of the cap main portion 1 so that the forward end of the engaging piece 20 is hooked on the extraction controlling projection Yd from below, becomes slightly larger.

In this state, the engaging piece 20 projecting upward abuts against the extraction controlling projection Yd to be easily bent downwardly. When the ring member 2 is further pulled upward from the above-mentioned state, the lower side of the forward end of the engaging piece 20 can smoothly move over the extraction controlling projection Yd. Thus, the ring member 2 on the container upper portion Ya side is relatively easily removed from the container upper portion Ya mainly when the container Y is thrown away.

For example, in a case that the container is made of glass, the whole container Y and cap Cp are easily separated to meet a separation requirement for trash collection when the container is thrown away. Also, in the embodiment as shown in the drawings, when the thin potions 24 are broken to separate into two ring constituting members 23, the ring member 2 can be easily removed from the container upper portion Ya when the container is thrown away.

In the embodiment shown in the drawings, ribs 15 are formed on the inner surface of the skirt portion of the cap main portion 1. The ribs 15 are situated in the splitting slots 25 of the ring member 2 before the ring member 2 is separated from the cap main portion 1.

In the embodiment shown in the drawings, a plurality of window holes 16 is disposed on the cylindrical lower end side of the cap main portion 1 along the peripheral direction so that the ring member 2 is visible from the outside.

The window holes 16 are formed on a joint portion between the main portion 11 of the cap main portion 1 and the skirt-like portion 10. Specifically, the window holes 16 are opened outward at the outer circumferential step surface 13 and opened inward at the inner circumferential step surface 12. Thus, it is easy to recognize that the cap main portion 1 has been removed from the container upper portion Ya at least once through the window holes.

The ring member 2 is detachably integrated with the cap main portion 1. Accordingly, unless the cap main portion 1 is removed from the container upper portion Ya, the ring member 2 is visible from the outside through the window holes 16, i.e. the ring member 2 is located inside the cap main portion 1. Since the window holes 16 are disposed along the peripheral direction of the cap main portion 1, it is possible to confirm the ring member 2 inside the cap main portion 1 by looking the container upper portion Ya from any direction.

When the cap main portion 1 is removed from the container upper portion Ya at least once, since the ring member 2 is separated from the cap main portion 1, the ring member 2 is not present inside the cap main portion 1. Thus, it is easy to recognize whether the cap main portion 1 is removed from the container upper portion Ya at least once. When the cap main portion 1 is made of a plastic having a color different from that of the ring member 2, it is possible to recognize more clearly that the cap main portion 1 is removed from the container upper portion Ya at lease once.

In the embodiment, when the cap main portion 1 and the ring member 2 are molded in the detachably integrated state, the plastic material of the ring member 2 enters the window holes 16 from the inner side of the cap main portion 1. As a result, a plurality of projections 26 is formed on the upper end of the ring member 2 with an equal space therebetween.

Also, in the present embodiment, fin-like members 27 are formed on an outer periphery of the ring member 2 and project toward the cylinder upper end side of the cap main portion 1. The fin-like member 27 is inserted into the thick portion of the cap main portion 1 to thereby detachably integrate the ring member 2 with the cap main portion 1. A portion of the fin-like member 27 at a side of the projecting end 27*a* is inclined in a direction intersecting with the cylinder axis of the cap main portion 1.

In the present embodiment, the fin-like member 27 has one end integrally connected to the lower end of the ring member 2 and projecting toward the ring upper end side. The fin-like member 27 includes a wide surface inclined away from the outer peripheral surface of the ring member 2 toward the ring projecting side. Accordingly, concave portions 17 are formed on the inner surface portion of the skirt-like portion 10 of the cap main portion 1 between the window hole 16 and the cylinder lower end of the cap main portion 1. The concave portion 17 has an entrance facing the cylinder lower end of the cap main portion 1. Also, the concave portion 17 has a concave shape similar to an outer shape of the fin-like member 27 and extending from the entrance to the inner side with an inclination toward the outer surface side of the skirt-like portion 10. The fin-like member 27 is inserted into the concave portion 17 to detachably integrate the ring member 2 with the cap main portion 1.

In the embodiment, a plurality of the fin-like members 27 is disposed along the peripheral direction of the ring member 2 with a substantially equal space between the adjacent fin-like members 27. A plurality of the concave portions 17 is formed on the skirt-like portion 10 of the cap main portion 1 along the peripheral direction thereof with a substantially equal space between the adjacent concave portions 17.

The fin-like members 27 have projecting ends 27*a* located on an imaginary circle having a diameter larger than that of the outer peripheral surface of the ring member 2, and slightly larger than an inner diameter of the cylinder lower end of the cap main portion 1, i.e. the inner diameter of the skirt-like portion 10. Accordingly, when the cap main portion 1 is removed from the container upper portion Ya for the first time, the cap main portion 1 is separated from the ring member 2 as the fin-like members 27 are extracted from the thick portion of the cap main portion 1.

When it is tried to produce the integrated state of the cap main portion 1 and the ring member 2 from the separated state, it is necessary to insert the fin-like members 27 into the thick portion of the cap main portion 1. However, the fin-like members 27 are inclined as described above and the concave portions 17 formed on the thick portion of the cap main portion where the fin-like members 27 are to be inserted have also the concave inner shapes similar to the inclination of the fin-like members 27. Therefore, it is very difficult to return the fin-like members 27 to the original positions.

As a result, in the present embodiment, after the cap main portion 1 is removed from the container upper portion Ya at lease once, it is difficult to integrate the ring member 2 with the cap main portion 1 again in the original state. Thus, it is difficult to intentionally conceal a fact that the cap main portion 1 is removed from the container upper portion Ya at least once, i.e. the container Y is opened at least once.

Especially, in the present embodiment, a plurality of the fin-like members 27 is provided, and the fin-like members 27 are difficult to return to the concave portions 17 of the cap main portion 1 as in the state before separation. Therefore, it is possible to prevent the intentional concealment.

Also, in the embodiment, it is possible to prevent a risk that the cap main portion 1 inadvertently returns to the original state when the cap main portion 1 is screwed in the container upper portion Ya from the separated state of the cap main portion 1 and the ring member 2.

According to the invention, it is possible to obtain a good appearance of the cap in the unopened state of the container while it is easy to recognize the unopened state of the container. Thus, it is possible to improve a design of the container using the cap without any obstacle.

While the invention has been explained with reference to the specific embodiments of the invention, the explanation is illustrative and the invention is limited only by the appended claims.

What is claimed is:

1. A cap for a container with an opening and an extraction controlling projection, comprising:

a cap main portion to be screwed in the container to close the opening of the container and having a hollow shape with a closed upper end and an open lower end, said cap main portion having a plurality of window holes disposed along a periphery at a lower side thereof and a thick wall portion formed below the window holes and having a smooth outer surface and grooves at an inner side thereof, and a ring member disposed inside and closely fitted with the cap main portion so that the ring member fitted in the cap main portion can be seen through the window holes, said ring member having engaging pieces formed on an inner periphery thereof for hooking on the extraction controlling projection of the container, and a plurality of fin members at an outer periphery thereof to project upwardly, said fin members being located in the grooves of the thick wall portion so that the ring member is detachably integrated with the cap main portion.

2. A cap according to claim 1, wherein said ring member has an outer surface detachably fixed to an inner surface of the cap main portion such that after injection molding one of the cap main portion and ring member, the other is molded with the one of cap main portion and the ring member.

3. A cap according to claim 1, wherein said fin members include projecting ends inclined outwardly in a direction of crossing a cylindrical axis of the cap main portion.

4. A cap according to claim 3, wherein said ring member includes a cylindrical portion, said fin members projecting from an outer surface of the cylindrical portion.

5. A cap according to claim 4, wherein said fin members are arranged in a peripheral direction with an interval between two adjacent fin members.

6. A cap according to claim 1, wherein said engaging pieces of the ring member are arranged such that when the cap main portion is screwed in the upper portion of the container, the engaging pieces deform elastically upwardly to move over the extraction controlling projection, and pass over the extraction controlling projection, and when the cap main portion is completely screwed, the engaging pieces hook under the extraction controlling projection.

7. A cap according to claim 1, wherein said ring member includes a plurality of ring components extending in a peripheral direction and connected together through thin wall portions so that the ring components can be separated from each other.

8. A cap according to claim 1, wherein said engaging pieces are arranged at a lower side of the ring member around the inner periphery thereof to be spaced apart from each other, said engaging pieces being inclined inwardly and upwardly in an engagement condition with the container.

9. A combination comprising a container and a cap, said container having a cylindrical portion, an opening at the cylindrical portion, and an extraction controlling projection formed around the cylindrical portion, and said cap including a cap main portion screwed into the cylindrical portion of the container to close the opening and having a hollow shape with a closed upper end and an open lower end, said cap main portion having a plurality of window holes disposed on a lower side thereof along a periphery thereof and a thick wall portion formed below the window holes and having a smooth outer surface and grooves at an inner side thereof; and a ring member disposed inside and closely fitted with the cap main portion so that the ring member fitted in the cap main portion can be seen through the window holes, said ring member having engaging pieces formed on an inner periphery thereof for hooking on the extraction controlling projection of the container, and a plurality of fin members at an outer periphery thereof to project upwardly, said fin members being located in the grooves of the thick wall portion so that the ring member is detachably integrated with the cap main portion.

10. A combination according to claim 9, wherein said fin members include projecting ends inclined outwardly in a direction of crossing a cylindrical axis of the cap main portion.

* * * * *